US006279230B1

(12) United States Patent
Eikhoff et al.

(10) Patent No.: US 6,279,230 B1
(45) Date of Patent: Aug. 28, 2001

(54) METHOD FOR FABRICATING A WHEEL COVER

(75) Inventors: Ted E. Eikhoff, Grosse Pointe; David H. Johnson, Berkley; Dannie J. MacNish, South Lyon, all of MI (US)

(73) Assignee: McKechnie Vehicle Components (USA), Inc., Troy, MI (US)

( * ) Notice: Subject to any disclaimer, the term of this patent is extended or adjusted under 35 U.S.C. 154(b) by 0 days.

(21) Appl. No.: 09/332,307

(22) Filed: Jun. 14, 1999

(51) Int. Cl.[7] ..... B21K 1/40
(52) U.S. Cl. ..... 29/894.381; 29/894.38
(58) Field of Search ..... 29/894.38, 894.381, 29/892.3; 72/86, 87, 370.1

(56) References Cited

U.S. PATENT DOCUMENTS

| | | | | |
|---|---|---|---|---|
| 2,057,565 | | 10/1936 | Eksergian | 301/5 |
| 3,025,819 | * | 3/1962 | Lyon | 29/894.381 |
| 3,214,220 | | 10/1965 | Foster et al. | 301/63 |
| 4,094,550 | | 6/1978 | Toal et al. | 301/37 R |
| 5,072,509 | * | 12/1991 | Bichel et al. | 29/892.3 |

FOREIGN PATENT DOCUMENTS

| | | | | |
|---|---|---|---|---|
| 38905 | * | 8/1965 | (DE) | 72/86 |

* cited by examiner

*Primary Examiner*—P. W. Echols
(74) *Attorney, Agent, or Firm*—Bliss McGlynn, P.C.

(57) ABSTRACT

A wheel cover is formed to include a wrap around the circumference of the wheel cover. The wrap is an aesthetic portion of the wheel cover and not a part of a mechanical lock. It is formed in the wheel cover by spinning the wheel cover about its central axis. When the wheel cover is spinning at an appropriate speed, at least one pair of rollers is moved toward the spinning wheel cover. Lock generating rollers provide a force which is directed radially outwardly while wrap generating rollers provide a force which is directed radially inwardly. This force is of such a magnitude that it forces the outer edge of the wheel cover to follow the contour of the rollers. When the wrap is completely formed, the rollers are removed from engagement with the wheel cover and the wheel cover is stopped from spinning. Once the wheel cover is removed from the fixture of the spinning machine, it proceeds with further manufacturing steps to complete the manufacturing thereof before it is mounted to a wheel.

8 Claims, 3 Drawing Sheets

FIG-4
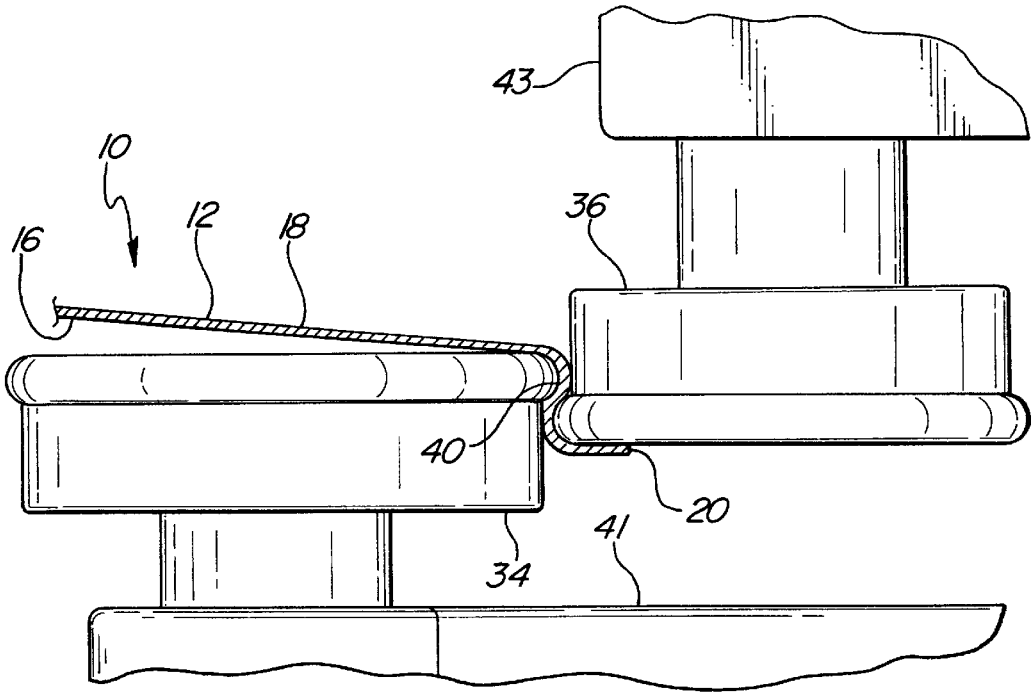
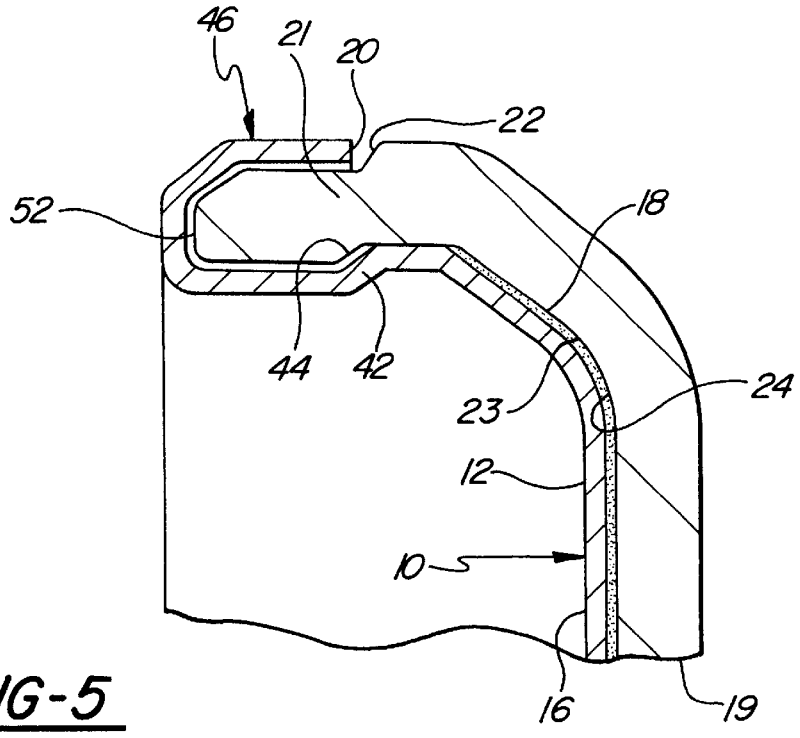
FIG-5

METHOD FOR FABRICATING A WHEEL COVER

BACKGROUND OF THE INVENTION

1. Field of the Invention

The invention relates to a method for fabricating a wheel cover. More specifically, the invention relates to a method for fabricating a wheel cover by forming an outer diameter having a mechanical lock at the outer edge thereof.

2. Description of the Related Art

Wheel covers are used to inexpensively provide an enhanced appearance for a steel wheel. Some wheel covers add a chromed or colored surface to the steel wheel without the costly step of actually chroming or painting the steel wheel. Chroming the steel wheel is costly because a steel wheel requires a great deal of surface finishing before it can receive the chrome material. Other wheel covers simulate an aluminum wheel. Because steel and aluminum wheels are capable of being manufactured to be as aesthetically pleasing as wheel covers, the primary advantage of the use of a wheel cover is to provide an aesthetically pleasing wheel surface at a low cost.

Therefore, the method for manufacturing wheel covers having a minimal number of flaws while maintaining the cost advantages is desired. One such method is disclosed in U.S. Pat. No. 3,214,220, issued to Foster et al. on Oct. 26, 1965. This patent discloses a wheel cover which is secured to an outer rim of a wheel. The wheel cover has a curl at its outer edge. The curl is created by rolling a disc of material inwardly. This curl is then forced into a groove formed within the outer rim of the wheel. Rolling is the act of forcing the outer rim of a disc out of its plane using a device which is moving radially outwardly from the center of the disc. Therefore, when a wheel cover is rolled, a roller or similar mechanism is rolled over the disc radially outwardly and then over the edge of the disc forcing the disc or wheel cover to have its outer edge curled. A crimping tool may be used in place of the rollers. This method is not desired because it forces anomalies in the thicknesses, i.e., bumps, of the disc due to the malleability thereof. Further, several rollers are required to ensure the rolling of the wheel cover is uniform. If several rollers or crimping tools are not used, the cycle time for such a mechanism will increase resulting in a higher manufacturing cost.

Another method for manufacturing a wheel cover is disclosed in U.S. Pat. No. 4,094,550, issued to Toal et al. on Jun. 13, 1978. This patent discloses a method for forming a wheel cover on a wheel. This patent also discloses folding or rolling over the edge of the trim ring, or wheel cover, to clinch a second piece of the resulting wheel cover. This act of rolling over is similar to that disclosed in U.S. Pat. No. 3,214,220, discussed above. A series of circumferentially spaced indentations are provided on the folded over portion of the trim ring member so as to prevent relative rotation between the members or pieces of the wheel cover and for the purpose of reducing noise. This rolled over edge does not enhance the ability of the wheel cover to be secured to the wheel. It is merely a point at which a support is secured to the wheel cover.

SUMMARY OF THE INVENTION

A method is disclosed for fabricating a wheel cover to permanently attach the wheel cover to a wheel. The wheel includes an outer rim flange. The method includes the step of forming a disc from a sheet of metal. The disc defines an outboard surface and an inboard surface, an outer edge and a central axis perpendicular to the outboard and inboard surfaces. The method also includes the step of stamping the disc to bend the disc through three dimensions. The method further includes the step of spinning the disc about the central axis. Finally, the method includes the step of applying a force to the outer edge of the disc while the disc is spinning to force the outer edge to bend over the inboard surface to create a wrap to be received by the outer rim of the wheel.

One advantage associated with the invention is the ability to manufacture a wheel cover to be mechanically locked to a wheel at the outer rim thereof. Another advantage associated with the invention is the ability to produce wheel covers through a reduced cycle time. Yet another advantage associated with the invention is the ability to eliminate bumps and any other anomalies which may be created when manufacturing a mechanical lock at the outer edge of the wheel cover. Still another advantage associated with the invention is to reduce the number of die operations into a single operation. A further advantage is the reduction of costs in the manufacturing of the wheel cover. Due to the versatility of the method, the method is advantageously interchangeable providing a single machine capable of manufacturing several different designs of wheel covers.

BRIEF DESCRIPTION OF THE DRAWINGS

Other advantages of the invention will be readily appreciated as the same becomes better understood by reference to the following detailed description when considered in connection with the accompanying drawings, wherein:

FIG. 4 is an enlarged side view partially cut away of the mechanical lock of a wheel cover engaged with two rollers; and FIG. 5 is a cross-sectional side view partially cut away of a wheel cover manufactured from the inventive method secured to a wheel.

DETAILED DESCRIPTION OF THE PREFERRED EMBODIMENT(S)

Figure 1:
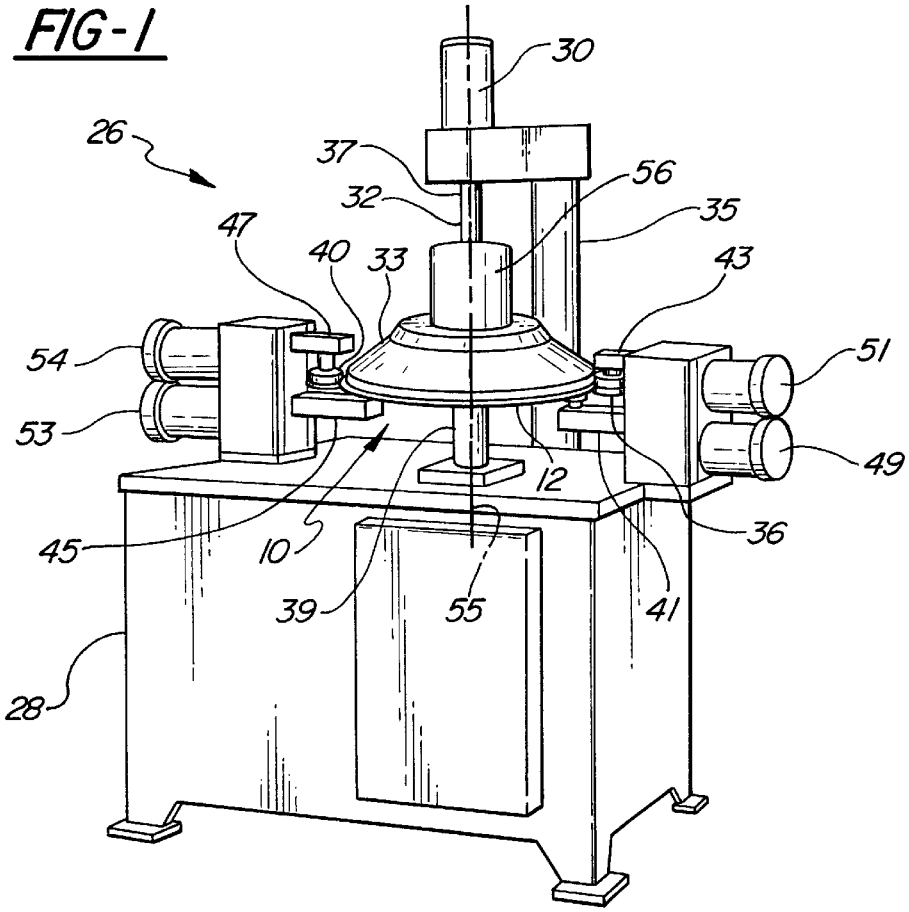
FIG. 1 is a perspective view of a machine incorporating the inventive method to manufacture a wheel cover.
Figure 3:
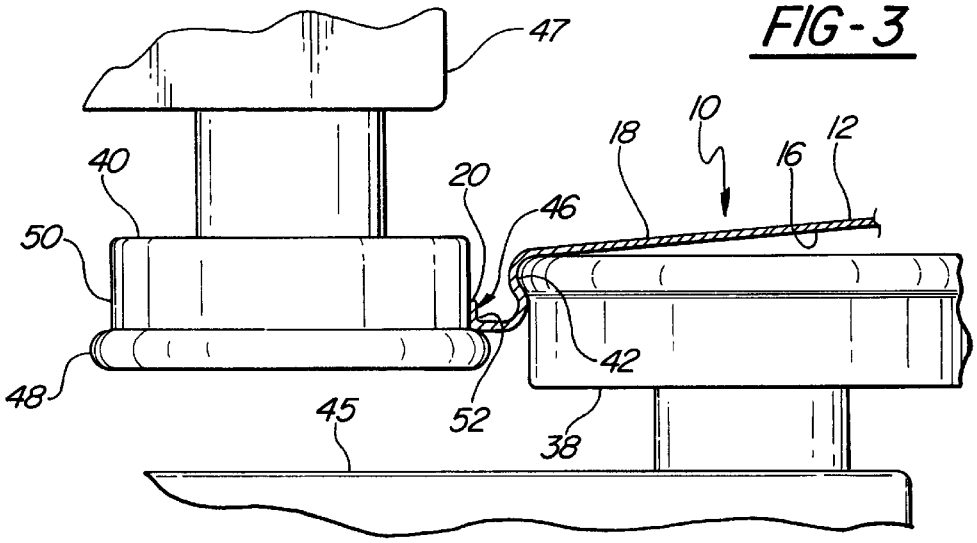
FIG. 3 is an enlarged side view partially cut away of the wrap of a wheel cover engaged with two rollers while forming the outer diameter.

Referring to the Figures, a wheel cover is generally indicated at 10. The wheel cover 10 includes a disc 12 of material. In one embodiment, the material is a malleable metal which has been stamped into a three-dimensional object.

The wheel cover 10 includes an outboard surface 16, an inboard surface 18 and an outer edge 20 extending therebetween. The outboard surface 16 is visible by someone when the wheel cover 10 is attached to a wheel 19 which is, in turn, attached to a wheel hub of a motor vehicle (neither shown).

The inboard surface 18 is the surface opposite the outboard surface 16. The inboard surface 18 faces the wheel 19 once it is attached thereto. The inboard surface 18 is not visible once the wheel cover 10 is secured to the wheel 19.

The outer edge 20 extends between the outboard 16 and inboard 18 surfaces. The outer edge 20 is formed in a manner such that it is capable of receiving an outer rim flange 21 of the wheel 19. When the outer edge 20 of the wheel cover 10 is spun formed, discussed in greater detail subsequently, it has an orientation which is generally perpendicular to its orientation prior to the completion of the inventive method. When secured to a wheel 19, the outer edge 20 is disposed adjacent an inboard surface 22 of the wheel 19 as is shown in U.S. Pat. No. 5,829,843 which is hereby incorporated by reference. A sealant 23 extends between an outboard surface 24 of the wheel 19 and the inboard surface 18 of the wheel cover 10.

A spinning machine is generally indicated at 26. The spinning machine 26 is used to form a lock 42 and a wrap 46, both of which are discussed subsequently, adjacent to and at the outer edge 20 of the wheel cover 10, respectively. The spinning machine 26 includes a base 28. An air cylinder 30 moves a central rod 32 axially. The central rod 32 includes a fixture element or nest 33 which secures the wheel cover 10 to the central rod 32. More specifically, the fixture element 33 locks the wheel cover 10 in place to be spun by the spinning machine 26. The central rod 32 depends from a frame 35 which is secured to the base 28. The frame 35 attaches to and/or holds a top end 37 of the central rod 32 in place. The air cylinder 30 is secured to the top of the frame 35. The air cylinder 30 is used to rotate or spin the fixture element 33 and the wheel cover 10 relative to the base 28. By positioning the fixture element 33 longitudinally, the spinning machine 26 may spin several discs 12 of different size and contour.

A rotating pedestal 39 supports and rotates the wheel cover 10 from below the wheel cover 10 and the fixture element 33. A motor (not shown) is housed within the base 28. The motor drives the rotating pedestal 39 using a belt drive (not shown) as is known in the art. Because the wheel cover 10 is secured to the rotating pedestal 39, the fixture element 33, the central rod 32 and the cylinder 30 all spin with the motor.

Figure 2B:
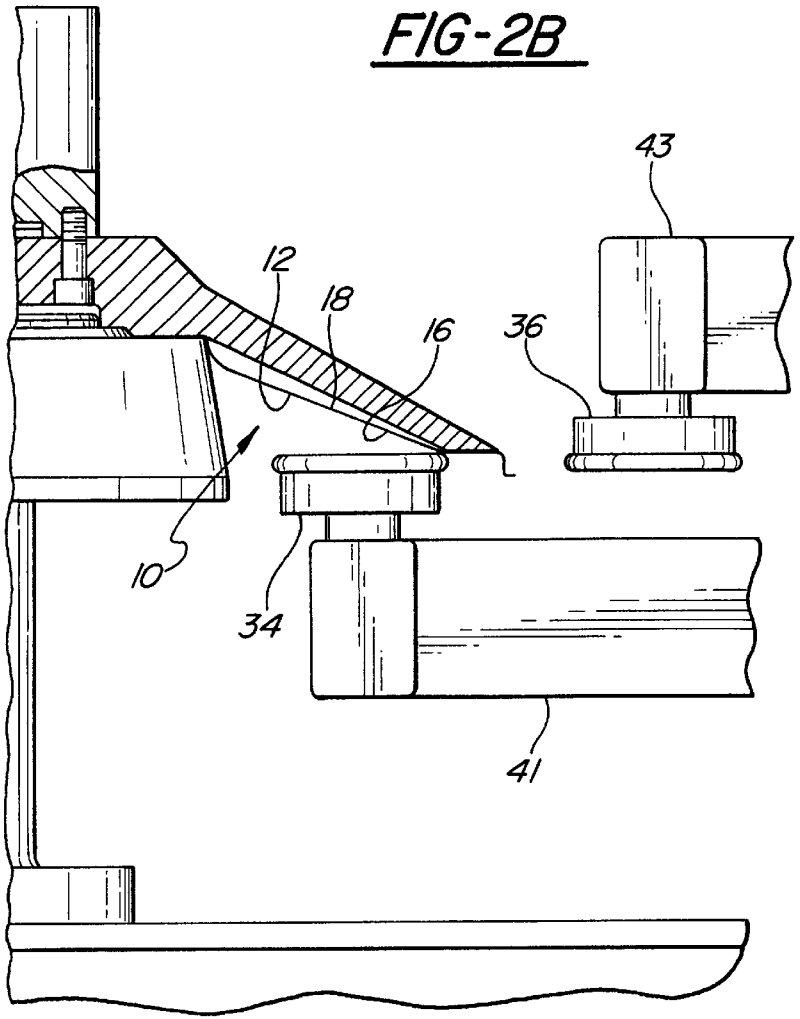
FIGS. 2A and 2B are side views partially cut away of a formed wrap in a spinning machine incorporating the inventive method to form an outer diameter and a mechanical lock, respectively.
Figure 2A:
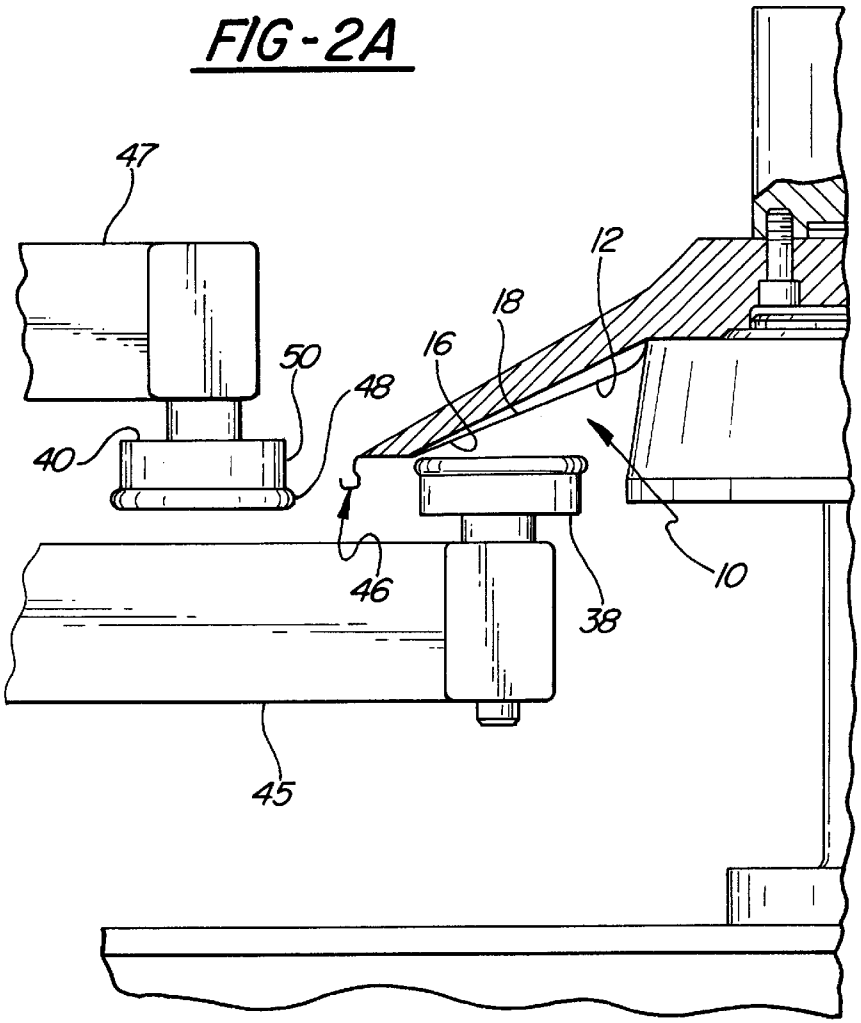

FIGS. 2A and 2B represent two steps in the method as the wheel cover 10 is being fabricated. In FIG. 2B, an internal lock roller 34 and an external lock roller 36 are shown. In FIG. 2A, an internal wrap roller 38 and an external wrap roller 40 are shown. As distinguished from the prior art cited above, the rollers 34, 36, 38, 40 neither stamp a roll in the outer edge 20 of the wheel cover 10 nor do they stamp the lock 42 therein. The roller assemblies 34, 36, 38, 40 are rotated by engaging a spinning wheel cover 10. By slowly forcing the rollers 34, 36, 38, 40 into the wheel cover 10, the disc 12 is bent or moved back along the contour of the rollers 34, 36, 38, 40, discussed subsequently. Arms 41, 43, 45, 47 hold the rollers 34, 36, 38, 40 in proper alignment, respectively. Air cylinders 49, 51, 53, 54 may be used to move the arms 41, 43, 45, 47 into and out of engagement with the wheel cover 10.

When generating a lock 42, as best seen in FIGS. 2B and 4, the internal lock roller 34 engages the outboard surface 16 of the disc 12. The external lock roller 36 engages the inboard surface 18. The relative movement between the external lock roller 36 and the internal lock roller 34 forces the disc 12 to conform to the profiles of the lock rollers 34, 36. Because the disc 12 is fabricated from a non-resilient material, the disc 12 will maintain the form of the lock rollers 34, 36 after they have disengaged the disc 12. The result of this step is the formation of the lock 42 which is disposed adjacent the outer edge 20. The lock 42 coacts with a catch 44 on the outboard surface 24 of the wheel 19 allowing the wheel cover 10 to be secured to the wheel 19.

When generating a wrap 46 in the wheel cover 10, the internal wrap roller 38 and external wrap roller 40 are moved relatively with respect to the wheel cover 10. The external wrap roller 40 engages the outer rim flange 21 and allows it to conform to the profile permitted by the external wrap roller 40 as the wheel cover 10 is spun by the motor. A bottom portion 48 of the external wrap roller 40 starts the creation of the wrap 46. A body portion 50 of the external wrap roller 40 guides the wrap 46 as the external wrap roller 40 is moved inwardly against the wheel cover 10. The arm 47 moves the external wrap roller 40 into and out of engagement with the wheel cover 10 using the air cylinder 54. A plurality of wrap rollers 38, 40 may be used. While the wrap 46 extends around a rim edge 52 of the outer rim flange 21, it is not used as a locking mechanism. It is aesthetic in nature as it covers the outer rim flange 21.

The method for fabricating the wheel cover 10 for permanent attachment to a wheel 19 having an outer rim flange 21 includes the step of forming a disc 12 from a sheet of metal. The disc 12 defines the outboard surface 16, the inboard surface 18, and the outer edge 20. The disc 12 also defines a central axis which is coaxial with the axis 55 of the central rod 32. The disc 12 is then stamped to bend the disc 12 through three dimensions. The disc 12 is stamped so that it may have a contour which is desired. Further, the disc 12 must have a contour capable of being received by the wheel 19. The contouring of the disc 12 changes the disc 12 from a two-dimensional object to a three-dimensional object.

Once the disc 12 is stamped, the disc 12 is mounted to the fixture element 33 which may or may not be already mounted to the central rod 32 of the spinning machine 26. Once mounted to the fixture element 33 and the fixture element 33 is mounted to the central rod 32 using a fastening structure 56, the central rod 32 is rotated by the motor. The rotation of the central rod 32 spins the disc 12 about its axis which is now aligned with the central axis 55 of the central rod 32.

Once the disc 12 is spinning at a desired speed, a force is applied to the disc 12 while the disc 12 continues to spin. This force is generated by the internal lock roller 34 and the external lock roller 36. The force applied to the disc 12 generates the lock 42. The lock generation is shown in FIG. 4. Once the lock 42 is created, the internal lock roller 34 and the external lock roller 36 are moved out of engagement with the disc 12.

The wrap 46 is generated subsequent to the generation of the lock 42. The wrap rollers 38, 40 engage the outer edge 20 and the portion of disc 12 disposed immediately adjacent the outer edge 20. The force applied to the outer edge 20 forces the outer edge 20 to bend over the inboard surface 18 to create the wrap 46 to be eventually received by the outer rim flange 21 of the wheel 19.

The force being applied to the outer edge 20 of the disc 12 is accomplished by moving the external wrap roller 40 radially into the outer edge 20 in a direction perpendicular to the central axis 55 of the central rod 32 and the rotating pedestal 39. Support for the disc 12 is provided by the internal wrap roller 38 which may be moved radially outwardly. The outer edge 20 follows the contour of the wrap generating rollers 38, 40. Therefore, by selecting the rollers 34, 36, 38, 40 with a specific circumferential profile or contour, specific lock and wrap profiles are also being selected. Although not shown, rollers 34, 36, 38, 40 having circumferential contours which are different from each other may be selected if the wrap profile is complex.

Once the wrap 46 has been created, the wrap rollers 38, 40 are removed from the disc 12. It may be appreciated that any number of roller combinations may be used. However, an even number of roller combinations diametrically opposed would stabilize the disc 12 while it was being spun by the spinning machine 26. An odd number of roller combinations or an even number of roller combinations which are not diametrically opposed would result in an uneven creation of the wrap 46 at the outer edge 20 of the wheel cover 10.

After the wheel cover 10 has stopped spinning, it is removed from the spinning machine 26. The wheel cover 10 may then be secured to the wheel 19 according to methods known to those skilled in the art. One such method is disclosed in U.S. Pat. No. 5,461,779 which is hereby incorporated by reference. The wrap 46 is not created around the outer rim flange 21 of the wheel 19. It is designed to receive the outer rim flange 21 therein only after it has been created.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

What is claimed is:

1. A method for fabricating a wheel cover for permanent attachment to a wheel having an outer rim flange, the method comprising the steps of:

securing the wheel cover to a spinning machine;

spinning the wheel cover about the central axis;

applying a lock generating force directed radially to an outboard surface of the wheel cover while the wheel cover is spinning to generate a mechanical lock to engage the wheel;

applying a wrap generating force to an outer edge and the outboard surface of the wheel cover while the wheel cover is spinning to force the outer edge to bend over the inboard surface to create a wrap to be received by the outer rim flange of the wheel.

2. A method as set forth in claim 1 wherein the step of applying a lock generating force includes the step of moving a roller radially outwardly into the outboard surface of the wheel cover.

3. A method as set forth in claim 2 wherein the step of applying a wrap generating force includes the step of moving a roller radially inwardly into the outer edge of the wheel cover and engaging the outboard surface of the wheel cover.

4. A method as set forth in claim 3 including the step of removing the roller from the disc after a wrap has been created.

5. A method as set form in claim 4 including the step of removing the roller from the disc after a lock has been created.

6. A method as set form in claim 1 wherein the steps of applying a lock generating force and a wrap generating force include the steps of moving a plurality of rollers into the outer edge and the outboard surface of the wheel cover.

7. A method for fabricating a wheel cover for permanent attachment to a wheel having an outer rim flange, the method comprising the steps of:

securing the wheel cover to a spinning machine;

spinning the wheel cover about the central axis; and applying a lock generating force between rollers to an outboard surface of the wheel cover while the wheel cover is spinning to generate a mechanical lock to engage the wheel.

8. A method for fabricating a wheel cover for permanent attachment to a wheel having an outer rim flange, the method comprising the steps of:

securing the wheel cover to a spinning machine;

spinning the wheel cover about the central axis; and applying a wrap generating force between rollers to an outer edge and the outboard surface of the wheel cover while the wheel cover is spinning to force the outer edge to bend over the inboard surface to create a wrap having a cavity to receive the outer rim flange of the wheel.

* * * * *